United States Patent [19]

Bennett

[11] Patent Number: 4,938,174

[45] Date of Patent: Jul. 3, 1990

[54] STEAM BOILER SYSTEM

[75] Inventor: Alan F. Bennett, Coventry, Great Britain

[73] Assignee: Spirax Sarco Limited, Cheltenham, England

[21] Appl. No.: 358,388

[22] PCT Filed: Nov. 23, 1987

[86] PCT No.: PCT/GB87/00832

§ 371 Date: May 25, 1989

§ 102(e) Date: May 25, 1989

[87] PCT Pub. No.: WO88/04008

PCT Pub. Date: Jun. 2, 1988

[30] Foreign Application Priority Data

Nov. 25, 1986 [GB] United Kingdom ..... 8628105
Mar. 4, 1987 [GB] United Kingdom ..... 8705000

[51] Int. Cl.[5] ..... F22B 37/54

[52] U.S. Cl. ..... 122/382; 210/696; 210/746

[58] Field of Search ..... 122/382; 210/696, 746; 137/2

[56] References Cited

U.S. PATENT DOCUMENTS 3,428,557 2/1969 Rivers ..... 210/746
4,347,430 8/1982 Leicester ..... 122/382
4,827,959 5/1989 Muccitelli ..... 122/382

*Primary Examiner*—William E. Wayner
*Attorney, Agent, or Firm*—Scrivener and Clarke

[57] ABSTRACT

A steam boiler having a water blow down in which the blowdown rate is automatically controlled in response to the flow rate and impurity level of the make up water so as to maintain the boiler water impurity level below a specified concentrations.

9 Claims, 1 Drawing Sheet

STEAM BOILER SYSTEM

This invention relates to a steam boiler system, and in particular to an improved apparatus and method for the blowdown control of steam boilers.

All steam boilers need to be "blown down", to avoid or limit the problems caused by impurities introduced by way of the boiler feed (make-up) water; these impurities become increasingly concentrated in the boiler water as steam is produced and used.

A typical problem arising from the build up of impurities, conventionally measured as total dissolved solids (TDS), is that these impurities form scale on the heat transfer surfaces, reducing efficiency and leading to possible component e.g. boiler tube, failure. On occasions there may be foaming within the boiler, with carry-over of boiler water with the steam, and then the contamination downstream of the boiler can result in electrolytic corrosion of the steam pipes, blockage of the pipes and/or slower heat exchange rates.

Traditional steam boiler practice is to specify a maximum permitted concentration of impurities in the boiler water; generally operators seek to maintain the boiler water near to this concentration by a blowdown procedure which consists of the replacement (either continuously or intermittently) of the boiler water by less-contaminated boiler feed water. The usual acceptable boiler water TDS is within the range 1500–3500 parts per million (ppm), but an actual specified value for a particular boiler will typically depend on the type of boiler, its scheduled operating pressure and the type of process plant requiring the steam output. It is a key operating procedure that the smallest quantity possible of boiler water should be blown down, since such water is at boiler temperature, and to discharge it to drain (even if heat recovery is attempted) is wasteful.

Of the existing blowdown procedures "intermittent blowdown" though still widely practised, is least favoured; the boiler water TDS decreases suddenly at each blowdown and then (following blowdown) slowly recovers towards the specified maximum for that boiler, the procedure being that an excess volume of boiler water is discharged at each blowdown which is wasteful of heated water—and this waste may be aggravated if the timing and duration of the blowdowns have been pre-set to cater for a different boiler operating condition or different process plant to be supplied. Thus many boiler operators nowadays use "continuous blowdown, manually set", with the manual setting being made by the operator based upon his experience with various boilers but though the worst excesses of intermittent blowdown are avoided, often too high and wasteful a rate of blowdown (kg/minute) is set by the operator in order that the blowdown will cater for the assumed worst operational boiler condition i.e. that leading to the specified maximum TDS most quickly. It is therefore also known to effect "automatic blowdown" in response to the current difference between the measured TDS in the boiler water and the maximum TDS specified for that boiler water, and to vary the continuous blowdown rate in dependence upon this difference; in known automatic blowdown systems an impurity sensor measuring boiler water conductivity is used to check directly the boiler water TDS, but the sensor is necessarily positioned either in a heated water boiler output line e.g. to a flash steam heat recovery system, or within the boiler itself, and so is subject to the abovementioned problems of impurity deposition (scale) and accelerated component failure from being required to operate continuously in a hostile high temperature environment.

We propose an alternative procedure, and apparatus and method suitable therefor. Thus we provide a steam boiler system which includes a steam boiler, a feed water inlet to the boiler for boiler feed water supply, a steam outlet from the boiler, a blowdown outlet from the boiler, and valve means which can be adjusted to provide a blowdown rate which is a proportion of the feed rate of the boiler feed water characterised by means comprising an impurity sensor to determine the TDS of the boiler feed water upstream of the boiler feed water inlet, flow means to determine the flow rate of the boiler feed water, and means automatically to control valve means in the blowdown outlet in response to the determined TDS and flow rate to set the blowdown outlet to provide a blowdown rate which is a calculated proportion of the flow rate of the boiler feed water, said proportion being calculated to provide a blowdown rate which will maintain the boiler TDS below a specified maximum concentration. Preferably the blowdown outlet will be set to provide a blowdown rate which is that proportion of the boiler feed rate which will maintain the boiler TDS substantially constant. The blowdown outlet will conveniently include both a solenoid operated blowdown valve movable between a closed condition and an open condition, and the blowdown valve by means of which the blowdown rate can be varied (when the solenoid operated blowdown valve is in its open condition) up to the maximum rate set by the solenoid operated blowdown valve; preferably, the blowdown valve will be downstream of the solenoid operated blowdown valve and thus subjected to heated water only when the solenoid operated blowdown valve is in its usual open condition.

We further provide a steam boiler system wherein the impurity sensor is positioned upstream of a hotwell in the make-up water line to the hotwell, the means to determine the TDS of the boiler feed water including electronic means adapted to receive signals from the impurity sensor and from a flow meter in the make-up water line to the hotwell and from a flowmeter downstream of the hotwell but upstream of the feed water inlet to the boiler, the means automatically to control the valve means being adapted to set the blowdown outlet in dependence upon a calculation of the total dissolved solids supplied to the boiler in the boiler feed water, the calculation being made by the electronic means.

We also provide a method of using a steam boiler system comprising a steam boiler, a feed water inlet to the boiler, furnace means to heat the water in the boiler to produce steam, a steam outlet from the boiler, a blowdown outlet from the boiler, and valve means to set the blowdown outlet to a blowdown rate which is a proportion of the feed rate of water to the boiler feed water inlet, and which includes the steps of exhausting steam through the steam outlet, opening the blowdown outlet to remove heated water and the dissolved solids therein from the boiler, and supplying feed water through the boiler feed water inlet to make up the loss of boiler water characterised by monitoring water flow rate upstream of the feed water inlet and by monitoring at least in part by an impurity sensor water TDS upstream of the feed water inlet, and by automatically controlling valve means in the blowdown outlet in response to the monitored flow rate and TDS to provide a blowdown rate which is a calculated proportion of the feed rate to the feed water inlet, the proportion being calculated from the said monitored flow rate and TDS, said proportion being calculated to provide a blowdown rate which will maintain the boiler TDS below a specified maximum concentration. Preferably the specified proportion is that proportion calculated to maintain the boiler TDS substantially constant.

As a particular feature of our invention we seek to provide a steam boiler blowdown system which includes an impurity sensor not subject to heated boiler water i.e. a system in which the impurity sensor is not required to operate at or near boiler water temperature. Conveniently the impurity sensor will be fitted in the fresh (make-up) water conduit to the hotwell, but alternatively can be fitted in the feed water input conduit downstream of the hotwell and this will be the preferred fitting position if there is chemical dosing of the hotwell water.

Once the setting of the valve means controlling the blowdown rate is altered, it will not normally be again altered until a specified minimum time period has elapsed, conveniently 30 minutes, to allow time (if necessary e.g. following a sudden change in feed water TDS) for a new boiler water TDS value to be approached i.e. intermittent valve setting alteration.

Whilst the impurity sensor can be positioned in the feed water input line adjacent the feed water inlet, preferably the impurity sensor is positioned up-stream of means e.g. a hotwell, either to mix a fresh charge of water with condensate return from the boiler or to top up the available condensate return with the necessary volume of fresh (make-up) water, with thereafter a calculation of the impurity level of the hotwell mixture. Because the condensate has negligible or nil TDS, and the fresh (make-up) water has a known TDS the TDS at the feed water inlet to the boiler may be obtained from a calculation of the proportions of condensate return and fresh water in the mix (from their measured or calculated flow rates into the hotwell).

It will be understood therefore that whilst the boiler TDS would normally tend to vary according to the feed water supply rate and its impurity proportion, this boiler TDS is controlled by an outflow rate through an automatically regulated blowdown outlet, with the blowdown rate calculated as a proportion of the feed water water supply rate, the proportion being selected in dependence on the specified TDS of the boiler water and the measured or calculated TDS of the feed water so that the boiler water TDS is held below a maximum specified value, which value can be changed as required.

Figure 1:
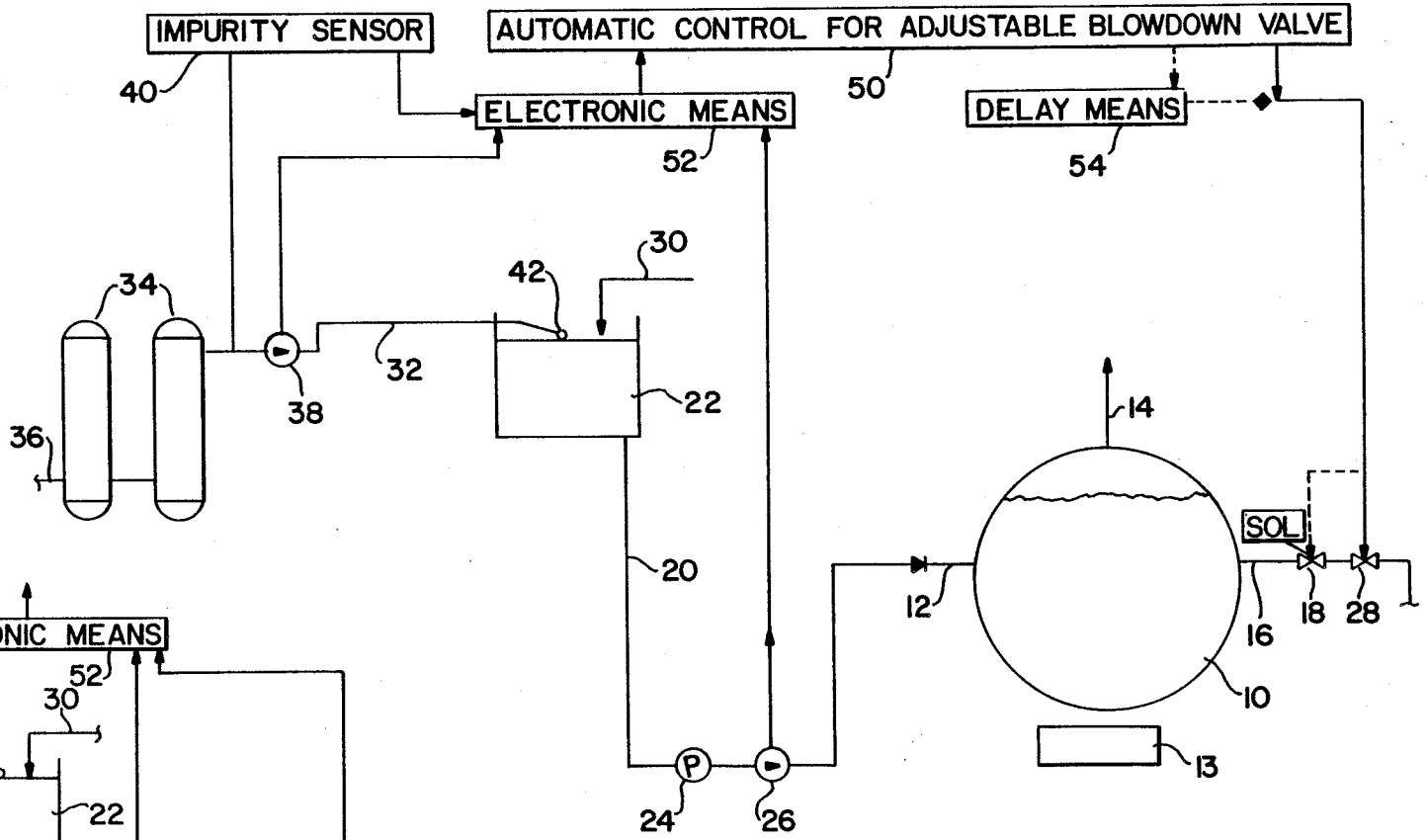
FIG. 1 shows the overall system of the invention.

Boiler 10 has a feed water inlet 12, furnace means 13 to heat the water in the boiler to produce steam, a steam outlet 14, and a blowdown outlet 16 controlled by a blowdown solenoid valve 18 of the type having a closed condition and an open condition, and by an adjustable valve 28 downstream of the blowdown valve 18. In an alternative embodiment boiler 10 additionally has a sludge outlet at its lowest point; the blowdown outlet 16 is then used for continuous blowdown, whilst the sludge outlet is used for intermittent blowdown, to a blowdown pit or blowdown receiver tank.

The feed water inlet 12 is connected by way of pipework 20 to hotwell 22, which though shown "open" is usually closed and lagged. Pipework 20 includes feed pump 24 and flowmeter 26.

Hotwell 22 is fed by conduit 30 carrying condensate return from the plant and by conduit 32 for the fresh make-up water from treatment plant 34. Raw water inlet 36 is to carry untreated water to treatment plant 34, which is of known construction and operation, and intended for instance to discharge into conduit 32 treated (fresh make-up) water at an appropriate purity for the plant it is supplying. Conduit 32 includes flowmeter 38.

The feed water supply, in this embodiment the fresh make-up water conduit 32, includes an impurity sensor 40 positioned upstream of hotwell 22 in the make-up water to the hotwell, the means for determining the TDS of the boiler feed water including electronic means 52 adapted to receive signals from the impurity sensor 40 and from flow meter 38 in the make-up water line 32 to the hotwell 22 and from flow meter 26 downstream of the hotwell 22 but upstream of the feed water inlet 12 to the boiler 10. An automatic control 50 for adjustment of the blow down valve 28 is adapted to set the blow down outlet in dependence upon a calculation by the electronic means 52 of TDS supplied to the boiler in the boiler feed water.

Figure 2:
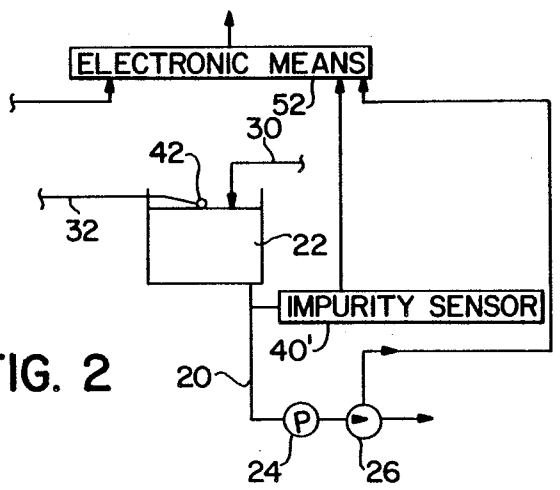
FIG. 2 shows an alternative embodiment in which the impurity sensor is located downstream of the hotwell.

Though conveniently the impurity sensor 40 is fitted in the fresh (make-up) water conduit 32 to the hotwell 22 as described above, alternatively, as shown in FIG. 2, the impurity sensor can be fitted in the feed water input conduit 20 downstream of the hotwell as shown at 40' and this is the preferred fitting position if there is chemical dosing of the hotwell water.

In operation, the amount of water drawn over a given time from hotwell 22 to feed water inlet 12 to maintain the water level in boiler 10 is known from flowmeter 26 in feed water conduit 20. The amount of water fed during this time period into hotwell 22 from condensate return conduit 30 can be calculated, assuming the level in hotwell 22 is kept constant as by ball cock 42, or alters by a known amount, since the amount of treated make-up water fed from conduit 32 into hotwell 22 is known from flowmeter 38. The dilution of the treated water TDS from conduit 32 by the condensate return from conduit 30 (or alternatively stated, the contamination of the condensate return by the make-up water) can be regularly and automatically calculated, as by our "Watchman" unit or other electronic calculator. Specifically the TDS level of the treated water in conduit 32 is known from impurity sensor 40, so that the resulting TDS level after dilution in hotwell 22 can be calculated, and monitored.

If preferred, the TDS level in hotwell 22 in conjunction with the flow measurement from flowmeter 26 can be used to calculate the appropriate blowdown regime. In an alternative embodiment the blowdown regime is held at the calculated value for e.g. the following 30 minutes, any further adjustment of the blowdown outlet being delayed by delay means 54 until this specified time period has elapsed.

EXAMPLE 1

| Impurity sensor 40 measures a TDS of 250 ppm. | |
|---|---|
| Over a specified period | Conduit 32 supplies 400 Kg treated water |

-continued

| Impurity sensor 40 measures a TDS of 250 ppm. | |
|---|---|
| | Conduit 30 supplies 1000 Kg condensate return. |
| Therefore Hotwell TDS = | 250 × 400/1400 = 71.5 ppm |
| Required boiler TDS = | 3000 ppm |
| For every 1 million units of feed water | 71.5 parts of impurity are introduced |
| For every 1 million units of blowdown | 3000 parts of impurity are removed. |
| Therefore blowdown rate = | 75.1/3000 × 100 |
| (as % of boiler feed rate) = | 2.4 approx. |

Although described with reference to a single water feed inlet and blowdown outlet, these terms are to include multiple inlets and/or outlets, as well as a single inlet and/or outlet for multiple boilers.

In an alternative embodiment, instead of seeking to maintain the boiler TDS at a constant level e.g. 3000 ppm, we allow it to fluctuate within specified limits, in one example with a 10% range. Advantages of this embodiment are that the adjustable valve 28 needs to be actuated less often, and that the outflow through adjustable valve 28 can often be at a steady rate making the subsequent handling of the blowdown water more straightforward.

I claim:

1. A steam boiler system which includes a steam boiler (10), a feed water inlet (12) to the boiler for boiler feed water supply, a steam outlet (14) from the boiler, a blowdown outlet (16) from the boiler, and valve means adjustable to provide a blowdown rate which is a porportion of the feed rate of the boiler feed water characterised by means comprising an impurity sensor (40) to determine the TDS of the boiler feed water upstream of the boiler feed water inlet, flow means (26) to determine the flow rate of the boiler feed water, and means automatically to control valve means (28) in the blowdown outlet in response to the determined TDS and flow rate to set the blowdown outlet to provide a blowdown rate which is a calculated proportion of the flow rate of the boiler feed water, said proportion being calculated to provide a blowdown rate which will maintain the boiler TDS below a specified maximum concentration.

2. A steam boiler system according to claim 1 characterised in that the impurity sensor measures the TDS of the water downstream of a hotwell.

3. A steam boiler system according to claim 1 characterised in that the impurity sensor is positioned upstream of a hotwell in the make-up water line to the hotwell, said means to determine the TDS of the boiler feed water including electronic means adapted to receive signals from the impurity sensor and from a flow meter in the make-up water line to the hotwell and from a flowmeter downstream of the hotwell but upstream of the feed water inlet to the boiler, the means automatically to control the valve means being adapted to set the blowdown outlet in dependence upon a calculation of the total dissolved solids supplied to the boiler in the boiler feed water, the calculation being made by the electronic means.

4. A steam boiler system according to claim 1 characterised by a solenoid operated valve (18) in the blowdown outlet, the solenoid operated valve being movable between a closed condition and an open condition.

5. A steam boiler system according to any one of claims 1 to 4 characterised by delay means to prevent a change in the setting of the valve means and thus of the blowdown outlet before a specified minimum time period has elapsed since the previous change.

6. A method of using a steam boiler system comprising a steam boiler (10), a feed water inlet (12) to the boiler, furnace means (13) to heat the water in the boiler to produce steam, a steam outlet (14) from the boiler, a blowdown outlet (16) from the boiler, and valve means to set the blowdown outlet to a blowdown rate which is a proportion of the feed rate of water to the boiler feed water inlet, and which includes the steps of exhausting steam through the steam outlet, opening the blowdown outlet to remove heated water and the dissolved solids therein from the boiler, and supplying feed water through the boiler feed water inlet to make up the loss of boiler water, characterised by monitoring water flow rate upstream of the feed water inlet (12) and by monitoring at least in part by an impurity sensor water TDS upstream of the feed water inlet (12), and by automatically controlling valve means (28) in the blowdown outlet in response to the monitored flow rate and TDS to provide a blowdown rate which is a calculated proportion of the feed rate to the feed water inlet, the proportion being calculated from the said monitored flow rate and TDS, said proportion being calculated to provide a blowdown rate which will maintain the boiler TDS below a specified maximum concentration.

7. A method according to claim 6 characterised by a hotwell (22), a conduit (20) connecting the hotwell to the feedwater inlet (12) for boiler feed water, a condensate return conduit (30) connected to the hotwell from downstream of the steam outlet (14), a fresh make-up water conduit (32) connected to the hotwell, the boiler feed water being an admixture of condensate return from condensate return conduit (30) and fresh make-up water from fresh water conduit (32), and which includes the steps of measuring the respective flow rates of the fresh make-up water and of the feed water to the boiler, and of measuring the total dissolved solids in the fresh make-up water by means of the impurity sensor, calculating the total dissolved solids supplied to the boiler in the boiler feed water, the said proportion being calculated electronically, and automatically controlling the valve means and thus the blowdown rate in dependence upon the results of that calculation.

8. A method according to claim 7 characterised in varying the blowdown outlet, and in then delaying a further adjustment of the blowdown outlet until a specified minimum time period has elapsed.

9. A method according to claim 7 or claim 8 characterised in that the blowdown outlet can be in an opened or a closed state according to the setting of a solenoid operated valve (18).

* * * * *